United States Patent [19]

Ruhlandt et al.

[11] Patent Number: 4,706,732

[45] Date of Patent: Nov. 17, 1987

[54] BORE CHILL FOR LOST FOAM CASTING PATTERN

[75] Inventors: Gerald K. Ruhlandt, Madison Heights; Romuald Gmurowski, Mt. Clemens, both of Mich.

[73] Assignee: General Motors Corporation, Detroit, Mich.

[21] Appl. No.: 909,713

[22] Filed: Sep. 22, 1986

Related U.S. Application Data

[63] Continuation-in-part of Ser. No. 891,993, Aug. 1, 1986, abandoned.

[51] Int. Cl.[4] ..... B22D 15/00

[52] U.S. Cl. ..... 164/353; 164/236; 164/246; 164/356; 164/34

[58] Field of Search ..... 164/34, 127, 137, 236, 164/246, 249, 339, 352, 353, 354, 355, 356

[56] References Cited

U.S. PATENT DOCUMENTS 4,520,858 6/1985 Ryntz, Jr. et al. ..... 164/34

*Primary Examiner*—Nicholas P. Godici
*Assistant Examiner*—Richard K. Seidel
*Attorney, Agent, or Firm*—Douglas D. Fekete

[57] ABSTRACT

A chill device for combination with a vaporizable pattern for casting metal by a lost foam process comprises a chill body receivable within a bore of the pattern and including a plurality of outwardly extending fins. The fins define channels therebetween for packing with mold sand to shape the cast metal and for venting pattern decomposition vapors during casting to avoid pore-forming entrapment in the cast metal. Also, the fins contact the bore surface to conduct heat into the chill body from the cast metal about the bore to accelerate solidification and thereby reduce shrink porosity. Thus, the chill device of this invention produces pore-free metal in the casting region immediately about the bore.

3 Claims, 3 Drawing Figures

BORE CHILL FOR LOST FOAM CASTING PATTERN

This is a continuation-in-part of U.S. Ser. No. 891,993, filed Aug. 1, 1986, now abandoned.

BACKGROUND OF THE INVENTION

This invention relates to a metal casting produced by a lost foam process utilizing a vaporizable pattern and having a bore surrounded by pore-free metal, such as an engine block casting having a combustion cylinder. More particularly, this invention relates to a foundry chill device receivable in the pattern bore to accelerate solidification of the cast metal thereabout, without interfering with venting pattern decomposition vapors, to reduce porosity in the casting region about the bore.

In a lost foam casting process, a vaporizable polymeric pattern is embedded in a gas-permeable mold formed of unbonded refractory particles, such as lake sand. The pattern is sized and shaped for duplication by the metal to produce a casting of a desired design. The pattern is preferably coated with a thin, vapor-permeable refractory layer to improve casting properties. Molten metal poured in the mold decomposes and replaces the pattern. Pattern decomposition vapors that form during casting vent through the coating into the mold. Vapors that fail to vent become entrapped in the metal and form pores in the product casting. Pores may also form as the result of shrinkage of the metal during solidification.

It has been proposed to cast an engine block for an automotive internal combustion engine by the lost foam process. The pattern for an engine block casting comprises a plurality of bores for forming combustion cylinder walls. Pore-free metal is required in the region surrounding the combustion cylinder. For casting, the bores are packed with the mold sand to shape the metal. Vapors vent into the packed bore to avoid entrapment. However, there remains a tendency for shrink pores to form in the metal about the combustion cylinder.

U.S. Pat. No. 4,520,858, issued to Ryntz et al in 1985, shows a chill member in combination with a lost foam pattern to reduce shrink porosity. The chill accelerates solidification of adjacent cast metal, whereupon shrinkage is fed by still-molten remote metal. In the described embodiment of the patent, the chill fits intimately and continuously against an external pattern surface. However, this continuous chill blocks vapors, which must vent by an alternate route to avoid entrapment. Development of alternate venting may be particularly difficult for vapors generated at a surface within the pattern, such as a bore.

It is an object of this invention to provide an improved foundry chill for use in combination with a vaporizable pattern in lost foam casting, which chill is locatable adjacent a pattern surface and permits pattern decomposition vapors to vent from the surface during casting to avoid entrapment, while accelerating solidification of replacement metal to reduce shrink porosity in the adjacent casting region.

It is a further object of this invention to provide a foundry chill device receivable in a bore of a vaporizable pattern for casting by the lost foam process, which chill is sized and shaped to allow sufficient pattern-mold contact to vent pattern decomposition vapors generated at the bore surface while increasing thermal conduction from the adjacent cast metal to accelerate solidification and thereby reduce shrink porosity.

SUMMARY OF THE INVENTION

In accordance with a preferred embodiment, a chill device of this invention comprises a generally cylindrical hollow chill body receivable in a cylindrical bore of a vaporizable pattern prior to embedding the pattern in an unbonded particulate mold for casting metal by a lost foam process. The pattern including the bore is coated with a thin, vapor-permeable refractory film of the type used in the lost foam process to improve casting qualities. The chill body is formed of a high thermal conductivity metal that is not fusible to the casting. The chill body comprises a plurality of circumferentially spaced, outwardly extending fins having tips for thermal conduction contact with the surrounding coated bore surface. Channels are defined between the fins and open adjacent the pattern bore. The chill body further defines an inner hollow that communicates with the channels through slots in the chill body. The channels and hollow are suitably open for communication with an ambient mold for packing with mold material when the pattern is embedded and for venting vapors into the ambient mold during casting. Also, the slots in the chill body include an arrangement of open-ended slots expandable circumferentially to uniformly increase the chill body diameter. The device of this invention preferably includes means for diametrically expanding the chill body to produce intimate contact between the fin tips and the coated bore surface.

For casting, the chill device is assembled with a coated pattern such that the chill body is positioned in a bore and expanded to urge the fin tips against the bore coating. The pattern-chill assembly is embedded in an unbonded sand mold, whereupon sand is packed into the channels and inner hollow to form a portion of the mold. Molten metal is cast into the mold to vaporize and replace the pattern. At the bore surface, the cast metal is shaped against the thin refractory coating supported by a combination of the fin tips and the sand mold within the channels. Pattern decomposition vapors at the bore surface vent through the coating into the channels and either along the channels into the ambient mold, or through the slots into the hollow and thereby into the ambient mold. Heat is conducted into the chill body through the fins to cool the metal about the bore. Although the refractory coating provides thermal insulation during the initial pattern replacement to ensure melt duplication of the entire pattern, the coating is suitably thin so that heat flow into the chill body occurs at a significant rate to cool the cast metal. In this manner, solidification of the casting region about the bore is accelerated, whereupon shrinkage is fed by still-molten remote metal to prevent the formation of shrink pores in the bore region. The product casting is removed from the mold, whereafter the chill device is returned to the original diameter and withdrawn.

Therefore, a product casting made using the chill device of this invention exhibits reduced porosity in the casting region immediately about a bore, such as a cylinder bore in an engine block casting. The chill body design allows pattern decomposition vapors to vent from the bore surface to avoid pore-forming entrapment in the cast metal. Also, the chill body accelerates cooling of the cast metal about the bore to successfully reduce shrink porosity. After casting, the chill device is readily removed from the product casting for re-use.

DESCRIPTION OF THE DRAWINGS

The present invention will be further described with reference to the accompanying drawings wherein.

DETAILED DESCRIPTION OF THE INVENTION

Figure 1:
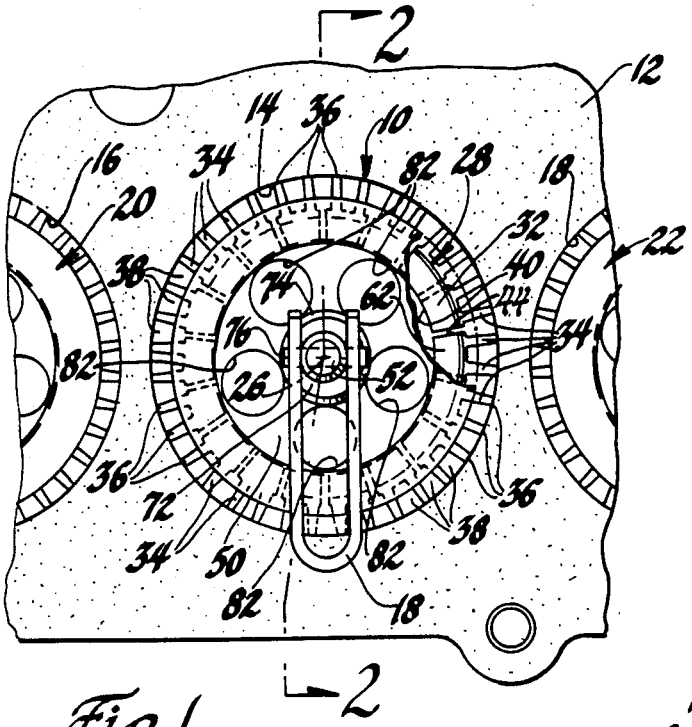
FIG. 1 is a plan view of a preferred chill device in accordance with this invention in combination with a lost foam pattern.
Figure 2:
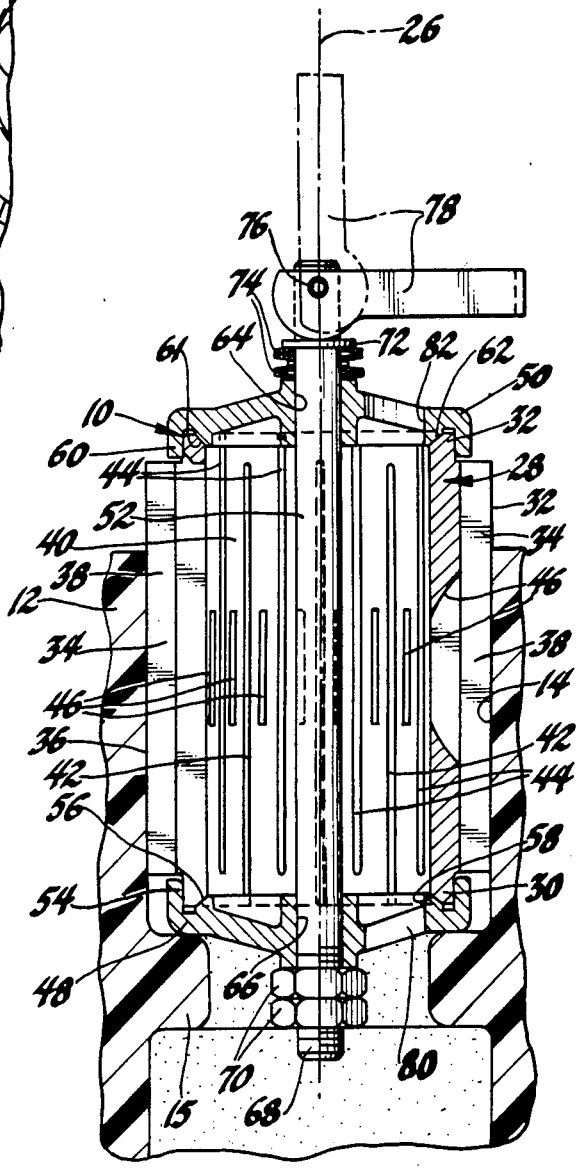
FIG. 2 is a cross-sectional view of the chill in FIG. 1 taken along the line 2—2 in the direction of the arrows.

In accordance with a preferred embodiment of this invention, a chill device 10 shown in FIGS. 1 and 2 is assembled with a polystyrene pattern 12, shown in part in FIGS. 1 and 2, for casting aluminum by a lost foam process. In this example, pattern 12 is sized and shaped for duplication by metal to produce an engine block casting. Pattern 12 includes a cylindrical bore 14 for producing a corresponding bore in the casting that is machinable to form a combustion cylinder wall in the product engine block. Pattern 12, including bore 14, preferably carries a thin, vapor-permeable refractory coating (not shown), similar to a core wash, to improve casting surface finish and provide additional thermal insulation during the initial stages of casting to prevent premature melt solidification and thereby assure metal duplication of the pattern. Chill 10 is inserted in pattern bore 14 to reduce porosity in cast metal replacing the pattern in the surrounding region. Within bore 14, chill 10 sits upon a ledge 15 shown in FIG. 2 so as to protrude from the pattern. The casting feature formed by ledge 15 is removed during machining of the product cylinder wall. Pattern 12 may have additional cylinder bores 16 and 18 as is typical for a multi-cylinder engine, into which are inserted additional chill devices 20 and 22 similar to chill device 10.

Figure 3:
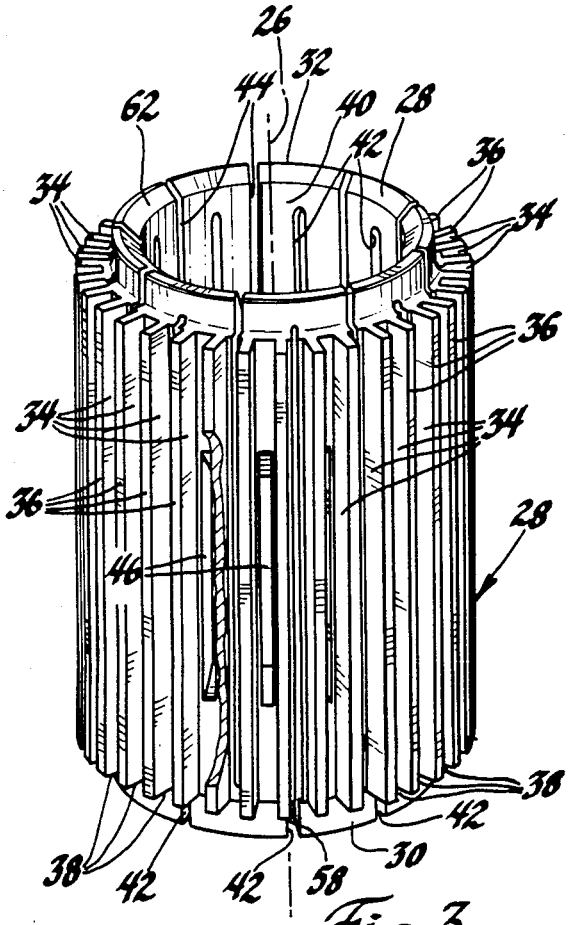
FIG. 3 is a perspective view showing separately the chill device body of the chill in FIGS. 1 and 2.

Chill device 10 comprises an expandable, hollow chill body 28 shown separately in FIG. 3. Chill body 28 is generally cylindrical about axis 26 corresponding to a central longitudinal bore axis, and comprises an interior end 30 within pattern bore 14 and an exterior end 32 outside the pattern. Chill body 28 further comprises a plurality of axial fins 34 facing radially outward and having outermost tips 36 for contact with pattern bore 14. Fins 34 are equidistantly spaced about the chill body circumference and define a plurality of axial channels 38 extending longitudinally adjacent bore 14. Channels 38 are open adjacent exterior end 32 for receiving mold sand and for venting vapors entering the channels at bore 14.

Chill body 28 also defines a central hollow 40 suitable for containing mold sand. Channels 38 communicate with hollow 40 for venting vapors thereto through slots 42, 44 and 46 such that each channel communicates with one such slot. Slots 42 extend axially from interior end 30 to a point adjacent but spaced from exterior end 32 and are arranged in a series of circumferentially spaced channels about the body. Similarly, slots 44 extend axially from exterior end 32 to a point adjacent but spaced from interior end 30 and are arranged in a series of circumferentially spaced channels about body 28, which series is circumferentially offset from slots 42 such that slots 44 alternate with slots 42 about the body. Open-ended slots 42 and 44 circumferentially widen to increase the circumference and the diameter of body 28. Although the individual slots widen most adjacent the open end, the overlapping arrangement permits the body diameter to be increased uniformly along the entire length. In this manner, body 28 is expandable to urge fin tips 36 into thermal conduction contact with pattern bore 14.

Chill device 10 comprises first and second end plates 48 and 50 connected by an axial bolt 52.

End plate 48 comprises an annular lip 54 that fits about chill body interior end 30 and a beveled annular shoulder 56 slideably engaging an inner annular beveled shoulder 58 of chill body 28. Similarly, end plate 50 comprises a lip 60 fitted about chill body exterior end 32 and an annular beveled shoulder 61 slideably engaging an inner annular beveled shoulder 62 of chill body exterior end 32. Bolt 52 extends through a central bore 64 in end plate 50 and a central bore 66 in interior end plate 48 and is secured at threaded end 68 by nuts 70. A cam lever 78 is pivotally connected by pin 76 to bolt 52 at the exterior end and spaced apart from end plate 50 by a flat washer 72 and spring washers 74. Cam lever 78 pivots between an axial position, indicated in phantom in FIG. 2 for inserting assembly 10 in pattern bore 14, and a locked position indicated by solid lines in FIG. 2 for urging fin tips 36 against pattern bore 14. In the insertable position, bolt 52 holds end plates 48 and 50 over the respective chill body ends with the chill body assuming an unstressed diameter characteristic of the free body. In the locked position, cam lever 78 bears down against washer 72 to reduce the effective axial distance between washer 72 and nut 70, thereby forcing end plates 48 and 50 together. In response, shoulders 56 and 60 slide against chill body shoulders 58 and 62 and force chill body 28 to expand. The expansion is accommodated by open-ended slots 42 and 44 and urges fin tips 36 into contact with pattern bore 14. End plate lips 54 and 60 serve as mechanical stops, preventing the chill body from expanding beyond the bore diameter and damaging the polystyrene pattern. End plates 48 and 50 are provided with a plurality of openings 80 and 82, respectively, for admitting mold sand to pack chill body hollow 40 and further for venting pattern decomposition vapors from the hollow into the ambient mold. Chill body 28 and end plates 48 and 50 are formed of high thermal conductivity tool steel designated AISI H13 that does not fuse to cast aluminum metal.

In preparation for casting, pattern 12 having bore 14 is manufactured in a separate operation prior to assembling with chill 10. A thin, porous refractory coating is preferably applied to the pattern surface including bore 14 by dipping the pattern in an aqueous slurry similar to a core wash and drying. The coating reduces melt penetration into the mold, referred to as burn-in, and provides thermal insulation suitable to prevent melt solidification prior to the completion of pattern replacement. The coating is typically between about 0.003 and 0.005 inch thick and is not shown in the Figures. The coating forms a physical barrier between the pattern 12 and the chill device 10, and thus subsequently between the replacement cast metal and chill device 10. However, the coating is suitably thin to allow heat dissipation to solidify the casting. Also, the coating is sufficiently porous to permit vapor to vent into the mold.

With cam lever 78 extending axially as indicated by phantom lines in FIG. 2 so that chill body 28 assumes an unstressed diameter, chill 10 is inserted into bore 14. The outer diameter of chill body 28 is sized suitably less than the diameter of bore 14 to provide clearance during insertion. Cam lever 78 is manually pivoted to the locked position shown in solid in FIG. 2, moving plates 48 and 50 together along axis 26. Beveled shoulders 56 and 61 force chill body shoulders 58 and 62, respectively, radially outward to increase the chill body on the order of 0.040 inch. Body ends 30 and 32 engage end plate lips 54 and 60, respectively, to prevent damage to the soft pattern. Open-ended slots 42 and 44 widen to accommodate the expansion. As the chill body expands, fin tips 36 are brought into contact with bore 14. Chill 10 is then locked into pattern 12 to facilitate handling during subsequent casting steps.

The pattern-chill assembly is embedded in a bed of unbonded sand in a manner suitable for forming a lost foam mold, for example, by fluidization of the sand bed. Mold sand enters through openings 80 and 82 to fill hollow 40. Mold sand also packs channels 38, entering the channels adjacent the chill body exterior end. Thus, the mold not only surrounds the embedded pattern-chill assembly, but also fills bore 14 to the extent not occupied by chill 10.

After the pattern-chill assembly is embedded in the sand mold, molten aluminum is cast into the mold, whereupon the molten aluminum vaporizes the polystyrene forming pattern 12 and assumes the pattern shape. At pattern bore 14, vapors produced by polystyrene decomposition vent through the porous coating and the mold material within channels 38. A portion of the vapors pass through slots 42, 44 and 46 into the sand filling chill body hollow 40 and thereafter through openings 80 and 82 into the bulk of the mold. A portion of the vapors may also flow along channels 38 into the surrounding mold. In this manner, the vapors escape to avoid entrapment in the metal replacing pattern 12 in the region about bore 14. At bore surface 14, the metal is shaped by the sand mold within channels 38 and by fin tips 36. However, the transfer of heat from the cast aluminum into chill body fin tips 36 increases the cooling rate of the surrounding metal to accelerate solidification thereof. As the metal in the region about the bore contracts during cooling and solidification, shrinkage is fed by still-molten aluminum in more remote regions from the casting, thereby eliminating shrink pores in the casting region about the bore. Also, as the metal contracts, the bore diameter decreases, whereupon the bore wall applies inward force against tips 36. This force is communicated to the end plates through the abutting annular shoulders and along axis 26 to contract spring washers 74. In this manner, chill device 10 responds to the inevitable shrinkage of the metal to prevent damage to the casting or to the chill device itself.

After the solidified casting is removed from the mold, chill device 10 is readily removed from the casting bore corresponding to pattern bore 14 by manually pivoting cam lever 78 to its axially extended position, whereupon the chill body springs back to thereby provide suitable clearance for withdrawing chill device 10 from the casting. The casting bore surface may then be suitably machined to finish the bore.

It is found that porosity in the casting region about a bore formed using a chill device in accordance with the described embodiment is substantially reduced. The device forms an escape route for venting vapors through the interfin channels to prevent vapor entrapment. A principal feature of the chill device is a chill body formed of a non-fusible, high thermal conductivity material that contacts the pattern surface to extract heat from replacement cast metal, including adjacent metal overlying the channels, to produce sound metal about the entire bore surface.

In the described embodiment, the chill device comprises means for expanding the chill body to bring the fin tips into intimate contact with the pattern surface. This invention may be suitably carried out by the chill body sized to intimately fit within the pattern bore without requiring diameter adjustment. However, in the manufacture of cylinder bores, it is preferred to expand the chill body diameter to provide clearance, while assuring intimate contact with the pattern bore, and thus with the casting bore, despite variations in the pattern bore diameter. The preferred means in the described embodiment for expanding the chill body diameter is relatively simple in construction and readily manually actuated. Also, the additional metal cooperates with the chill body to increase the effective heat sink mass. However, other means may be suitably substituted for expanding the chill body diameter into contact with the bore surface. Further, although the pattern in the described embodiment carries a preferred refractory coating, the coating is not mandatory for the chill device of this invention, but rather the chill device may be used in combination with an uncoated bore in applications that do not require a bore coating.

While in the described embodiment a single chill body is individually inserted into a pattern bore, this invention is also suitable to produce a single device comprising multiple chill bodies simultaneously insertable into multiple pattern bores. A fixture may feature a common means to concurrently lock the chill bodies in their respective bores, such as a single, pivotable handle.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. In combination with a vaporizable pattern for casting metal by a lost foam process that comprises embedding the pattern in a vapor-permeable mold formed of unbonded particles and casting metal into the mold to vaporize and replace the embedded pattern to form a product casting, said pattern defining a bore for forming a corresponding bore in the product casting, a chill device comprising a chill body receivable in said pattern bore comprising a plurality of outwardly extending fins in a spaced arrangement to define channels therebetween, said fins comprising an outermost tip for contact with the bore surface to conduct heat from replacement metal during casting, said channels communicating with the ambient mold for receiving metal-shaping mold material and venting vapors into the ambient mold.

2. A foundry chill device for combination with a vaporizable pattern for casting metal by a lost foam process that comprises embedding the pattern in a vapor-permeable mold formed of unbonded particles and casting metal into the mold to vaporize and replace the embedded pattern to form a product casting, said pattern defining a cylindrical bore for forming a corresponding bore in the product casting, said chill device comprising a generally cylindrical, expandable chill body receivable in said pattern bore and generally cylindrical about an axis corresponding to the bore axis, said chill body having an exterior end and comprising a plurality of axial fins outwardly radially extending for contact with the pattern bore and circumferentially spaced to define axial channels adjacent the bore, said axial channels being sufficiently open at the body exterior end for receiving mold material and for venting vapors into the ambient mold, said body being expandable between a first diameter sized less than the pattern bore diameter to provide clearance to facilitate insertion of the chill body into the pattern bore and withdrawal of the chill body from the casting bore and a second, relatively larger diameter for urging said fins into contact with said pattern bore, and means for expanding said chill body to urge said fin tips into contact with the pattern bore to conduct heat from cast metal replacing the pattern to accelerate solidification of said cast metal about said bore to reduce shrink porosity therein.

3. A foundry chill device for combination with a vaporizable pattern for casting metal by a lost foam process that comprises embedding the pattern having a thin, vapor-permeable refractory coating in a vapor-permeable mold formed of unbonded particles and casting metal into the mold to vaporize and replace the embedded pattern to form a product casting, said pattern defining a coated cylindrical bore for forming a corresponding bore in the product casting, said chill device venting pattern decomposition vapors at the bore surface to avoid pore-forming entrapment in the cast metal and accelerating solidification of the cast metal about the bore to reduce shrink porosity therein, said chill device comprising a generally cylindrical, diametrically expandable, hollow chill body receivable in said pattern bore and generally symmetrical about an axis corresponding to the bore axis, said chill body having an interior end within the pattern and an exterior end adjacent the ambient mold and being formed of a high thermal conductivity metal nonfusible to the cast metal, said chill body comprising a plurality of axial fins outwardly radially extending from the body and circumferentially spaced to define axial channels therebetween, said fins comprising an outermost tip for contact with the coated bore surface for conducting heat from replacement metal during casting, said axial channels being open at said exterior end for communication with the ambient mold for receiving mold material and venting vapors into the ambient mold, said body further comprising a central hollow communicating with said channels through slots in said body for venting vapors from said channels, said slots comprising open-ended slots extending axially from the body interior end along a first series of channels and open-ended slots extending axially from the body exterior end along a second series of channels in alternate arrangement with said first series, said slots being circumferentially expandable to accommodate expansion of the body diameter from a first dimension less than the pattern bore diameter to provide clearance to facilitate insertion of the body into the pattern bore and a second, expanded dimension to urge said fin tips into contact with said coated pattern bore, said body further comprising annular beveled shoulders at said ends for communication of radially outward force to said body, and a first end plate overlying said body exterior end and having an annular beveled shoulder slideably engaging said chill body exterior end shoulder, said first end plate having openings for communication between said body hollow and the ambient mold for filling the hollow with mold material and for venting vapors from said hollow, a second end plate overlying said body interior end and having an annular beveled shoulder slideably engaging said chill body interior end shoulder, and means for axially forcing said end plates relatively together to cause said end plate shoulders to force said chill body shoulders radially outward to diametrically expand the chill body to urge the fin tips against said pattern bore for thermal conduction communication with pattern replacement metal to conduct heat into the body from the cast metal to accelerate solidification and thereby reduce shrink porosity in the casting region about the bore.

* * * * *